US009453363B2

(12) United States Patent
Sønderkær et al.

(10) Patent No.: US 9,453,363 B2
(45) Date of Patent: Sep. 27, 2016

(54) METHOD FOR MAKING A PANE MODULE AND A WINDOW COMPRISING SUCH A PANE MODULE

(71) Applicant: VKR Holding A/S, Hørsholm (DK)

(72) Inventors: Peter Sønderkær, Horsens (DK); Kristian Ørnsvig Nielsen, Hornsyld (DK); Lars Kristensen, Ostbirk (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 14/957,838

(22) Filed: Dec. 3, 2015

(65) Prior Publication Data

US 2016/0138323 A1 May 19, 2016

Related U.S. Application Data

(60) Continuation-in-part of application No. 14/322,955, filed on Jul. 3, 2014, now Pat. No. 9,376,852, which is a division of application No. 12/452,998, filed as application No. PCT/DK2008/050186 on Jul. 31, 2008, now Pat. No. 9,115,536.

(30) Foreign Application Priority Data

Aug. 3, 2007 (DK) ..... 2007 01121

(51) Int. Cl.
*E06B 3/66* (2006.01)
*E06B 3/54* (2006.01)
*E06B 3/663* (2006.01)

(52) U.S. Cl.
CPC ..... *E06B 3/6625* (2013.01); *E06B 3/5427* (2013.01); *E06B 3/66* (2013.01); *E06B 3/663* (2013.01); *E06B 3/6617* (2013.01); *E06B 3/6621* (2013.01)

(58) Field of Classification Search
CPC .... E06B 3/66; E06B 3/28; E06B 2003/5472; E06B 3/663; E06B 3/6625; E04B 2/96; E04B 2/967
See application file for complete search history.

(56) References Cited

U.S. PATENT DOCUMENTS

| | | | | | |
|---|---|---|---|---|---|
| 1,524,910 | A * | 2/1925 | Carmichael | E06B 3/5454 | 52/455 |
| 2,050,733 | A * | 8/1936 | Campbell | E06B 3/28 | 160/40 |
| 2,244,491 | A | 6/1941 | Englehart | | |
| 2,719,341 | A * | 10/1955 | Clerk | E06B 3/28 | 52/204.591 |
| 2,725,606 | A * | 12/1955 | Persson | E06B 3/5454 | 160/107 |
| 5,061,531 | A * | 10/1991 | Catalano | E06B 3/20 | 156/107 |
| 5,430,981 | A | 7/1995 | Scott | | |
| 5,501,888 | A * | 3/1996 | Hanson | B44C 5/08 | 156/100 |
| 6,210,507 | B1 | 4/2001 | Hansen et al. | | |
| 8,176,707 | B2 * | 5/2012 | Gosling | E04B 2/7455 | 52/239 |
| 8,720,135 | B2 * | 5/2014 | Sonderkær | E06B 3/5427 | 52/204.55 |
| 8,943,769 | B2 * | 2/2015 | Sonderkær | E04D 12/002 | 52/204.593 |
| 9,016,009 | B2 * | 4/2015 | Sonderkær | E04D 12/002 | 52/209 |
| 9,016,010 | B2 * | 4/2015 | Sonderkær | E04D 12/002 | 52/209 |

(Continued)

*Primary Examiner* — Andrew J Triggs
(74) *Attorney, Agent, or Firm* — Merek, Blackmon & Voorhees, LLC

(57) ABSTRACT

The pane module comprises a pane element composed by glass sheets (31, 35) and provided with a border element (37, 38) by molding. The border element is adhered to the pane element during the molding process and at least partially encases the border of at least one sheet element.

20 Claims, 5 Drawing Sheets

(56) References Cited

U.S. PATENT DOCUMENTS 9,115,536 B2 * 8/2015 Sonderkær ..... E06B 3/5427
2005/0016045 A1 * 1/2005 Lasher ..... A47G 1/06 40/759
2005/0183384 A1 * 8/2005 Sonderkaer ..... E06B 3/66 52/782.1
2008/0302015 A1 * 12/2008 Thorne ..... E05F 15/63 49/70
2010/0199591 A1 * 8/2010 Sonderkaer ..... E06B 3/5427 52/656.6
2010/0205879 A1 * 8/2010 Sonderkær ..... E06B 3/5427 52/204.593
2010/0205881 A1 * 8/2010 Sonderkaer ..... E04D 12/002 52/209
2012/0137607 A1 * 6/2012 Kristensen ..... E04D 13/0354 52/204.62
2013/0326973 A1 * 12/2013 Rivera ..... E06B 3/28 52/202
2014/0305052 A1 * 10/2014 Sonderk R ..... E06B 3/5427 52/204.593
2014/0305053 A1 * 10/2014 Sonderk R ..... E04D 12/002 52/204.593
2014/0305054 A1 * 10/2014 Sonderk R ..... E04D 12/002 52/204.595
2015/0064373 A1 * 3/2015 Sonderk R ..... E06B 3/5427 428/34

* cited by examiner

METHOD FOR MAKING A PANE MODULE AND A WINDOW COMPRISING SUCH A PANE MODULE

RELATED APPLICATIONS

The present application is a continuation-in-part of U.S. patent application Ser. No. 14/322,955 filed on Jul. 3, 2014 which is a divisional of U.S. patent application Ser. No. 12/452,998 filed on Apr. 21, 2010, now U.S. Pat. No. 9,115,536 issued on Aug. 25, 2015, which is a 371 application of International Application No. PCT/DK2008/050186 filed on Jul. 31, 2008 which claims priority from foreign application No. PA 2007 01121 filed in Denmark on Aug. 3, 2007. Ser. No. 14/322,955 is hereby incorporated herein by reference in its entirety.

The invention relates to a method for making a pane module adapted to be installed in a window frame and comprising a pane element, which includes a first sheet element intended to face the exterior and a second sheet element intended to face the interior of a building in the mounted state, said sheet elements, such as sheets of glass, being separated by one or more spacer members. The invention further relates to a window comprising such a pane module, said window being intended for use in residential, office or industrial buildings.

When glazing vertical windows as well as roof windows the pane is usually secured to a glass-carrying frame, i.e. traditionally the sash, by means of glazing profiles fastened to the frame by means of screws. The pane is kept in place by means of glass spacers and glazing clips. Though it has proven very efficient this method suffers from a number of disadvantages, among others the large number of different parts needed for the glazing and the fact that the discontinuous support may cause potentially destructive strains on the pane, particularly when using a conventional glass sheet pane. This influences the lifespan of the pane with respect to breakage and failure in the sealing, the latter resulting in the formation of condensation in the space between the two sheets of glass constituting the pane.

More recently, attempts have also been made to attach the pane to the frame by means of gluing. This has provided a continuous support for the pane, enabling it to carry a larger share of the loads inflicted by wind and other weather-related factors. This, in turn, allows the use of more slender frame profiles with reduced weight and the design of the frame profiles may be dedicated to the achievement of improved insulation properties. Last but not least, the slimmer frame structures allow an increase of the pane area, increasing the inlet of light and thereby the utilization of the free heating of the sun.

In recent years the technology of gluing has developed into a realistic alternative to a conventional glazing of a pane module, as it is now possible to make a glued connection which has a good resistance to dynamical loads, heat, UV and even moisture. Gluing has for example been used in the so-called "instant glazing" technique, where adhesive replace sealing and rubber gaskets, and pane modules have been glued to the sash or glazing profile to obtain a structural connection between pane and sash or frame.

Gluing technology has, however, not penetrated the large volume market for windows and the application in fenestration and glazing still has several unsolved problems. For instance, a satisfactory solution to the problem of securing the pane in the event of adhesion failure has not been provided, and design criteria relating to strength and mechanical properties of the glue are also lacking. Moreover, the quality of the glued connection is sensitive to the environment at the location where the gluing is performed, to the preparation of the adhesion surfaces etc. and the employees performing the gluing must therefore be specially trained. This entails the necessity of large investments in climatic control, quality control systems and staff training. Standards for pane and window design criteria's have not yet been provided.

It is therefore the object of the invention to provide a method for making a pane module, which may be attached to the window frame in a secure and durable manner and with the use of fewer parts than what is needed for conventional glazing.

This is achieved by a method, where the pane element is provided with a border element by moulding, the border element adhering to the pane element during the moulding process and at least partially encasing the border of at least one sheet element.

By attaching the pane element to a border element a continuous support along the entire edge of the pane in achieved, but without the need for glue. The border element are subsequently attached to a window frame by means of screws, moulding or any other suitable means, detachable or not. There is thus no need for glazing dips etc. and the fact that the border of the pane is protected by the border element makes the mounting process less delicate. In this, the term "frame" covers both stationary and moveable frames including traditional sashes. Furthermore, the term includes such elements, which includes other elements as well, and the pane module may be used with any type of window regardless of the number of frames etc.

The term "encase" should not be understood as if the border element encloses or embraces the entire edge of the pane; the mere contact between surfaces of the border element and pane may give a sufficient attachment by adherence.

When using conventional thermo panes and the like, the border element may be made to embrace the border of the pane entirely, thus functioning as a secondary pane sealing. It is however, also possible to mould the border element entirely on the interior side of the pane, with a shape that allows adherence to the exterior side only or so that it contacts only an edge face of one or both sheet elements. Combinations of the modes of attachment are also possible, meaning that the border element may for example adhere to both the edge and exterior face and that the border element may be attached in different ways at different sides of the pane element. The border element may also adhere to spacer members, sealings and the like.

Other types of panes have projecting edges that may be used for the attachment of the border element. One example is step unit panes, where the edge of one of the glass sheet elements projects over the edge of the other and over the spacer members. The border element may then be attached to the border of the projecting sheet element, either on the interior, exterior or edge face(s). Attachment to the smaller pane is also possible, particularly to the edge faces thereof.

A two sheet pane may also be constructed during the making of the pane module. If the first sheet element are attached to the border element by the moulding process, the second sheet element may then subsequently or simultaneously be connected to the first sheet element or vice versa. This method will usually leave a space between the border element and the second sheet element. This space may be used for the introduction of filler gasses or the like in the cavity between the two sheet elements of the pane and for the introduction of a secondary pane sealing. When such operations are completed, the space is closed with a caulking compound.

Regardless of the pane type the sheet elements may be parallel to each other, as is most commonly the case, or one may be inclined in relation to the other so that the distance between them vary. This latter kind of pane has particularly good sound insulating properties and the principle may also be applied to three-sheet panes to thereby achieve an even better sound-proofing.

Pane elements are usually rectangular, but other shapes such as square, circular, semi-circular, triangular or trapezoidal may also be used.

Depending among others on the type of pane element and the functionalities to be possessed, the border element may be made to encase all border edges of at least one sheet element or only some of them. Encasing all edges gives a particularly good hold of the pane element, but to allow the subsequent addition of associated elements such as roller shutters it may be advantageous to leave one or more edges of at least one of the sheet element free. Particularly when using step unit panes the encasement may also be limited to only one of the two sheet elements, but in other cases it may be advantageous that edges of each of the two sheet elements are encased by the border element. An obvious example is the encasement of thermo panes, where the border edges of the two sheet elements are in line. The insulating properties of a step unit pane module may, however, also be improved by encasing both sheet elements and for some uses it may also be advantageous that the interior sheet element is encased at the top and bottom, whereas the exterior sheet element are encased at the sides or vice versa.

The border element may be seen as having a number of functional faces serving as a seat for a number of functions necessary for the functionality of the window, amongst others covering member carriers, water guidance means, electrical components, sealings and components contributing to the stiffness and strength of the construction. These functions have hitherto been associated with the frame(s) of the window and the provision of a border element having functional faces thus allows a simpler construction of the frame elements.

One example of a functional face is that the border element is made with a nose projecting over the edge of the pane element above the exterior surface of the exterior sheet element, the nose covering the joint between the pane element and the border element. In this way the exterior face of the border element serves the function of protecting the joint and the nose will retain the pane in the event that the connection between the border element and the pane should fail. The nose may be moulded as an integral part of the border element or it may be formed by a projecting fitting, such as an aluminium rail.

The exterior face of the border element may, however, also be made level with the exterior surface of pane to thereby serve the function of draining off rainwater or level with the interior surface of pane, serving purely as a face of attachment and allowing the pane to project over the border element and frame.

In still another embodiment, the exterior face of the border element is provided with a feather projecting substantially perpendicularly to the plane of the pane. Such a feather may serve as a guide for water to be drained off, preventing it from penetrating into the joint between the window and the facade in which it mounted.

The term "functional face" is not limited to properties of the moulding material or moulded part of the border element. On the contrary, embedding a fitting in the material so that it projects through the face may impart the functionality. Such a fitting may for example be used for connecting the border element to a cladding element, to a window screening element or to a window frame.

If using a window frame made from plastic, aluminium or another mouldable material, the connection of the pane module thereto may also be achieved by moulding. Either the moulding materials of the two components have sufficient adhesive force to effect a reliable connection or a fitting is embedded with one end in the frame and the other in the border element. Alternatively the component made first is provided with a swallowtail-shaped groove, which the moulding material of the second component may enter, thus forming a permanent connection. The moulding of the window frame may be performed before, simultaneously or after the moulding of the border element.

The border element may be made by combining a number of border members that are moulded separately or has different configurations. If for example the border element is provided with a feather, the feather on the lower member of the border element may be provided with drain holes or interruptions or may be left out entirely on this border member.

The moulding are preferably performed by reaction injection moulding (RIM) or low pressure moulding. Thermoplast such as polyurethane or polyolefin are preferred moulding materials. Other suitable materials include thermoplastic materials such as PVC, PE or PP, a thermoplastic elastomeric (TPE) and thermoset elastomer materials such as ethylene propylene diene monomer (EDPM).

BRIEF DESCRIPTION OF THE DRAWINGS

In the following, the invention will be described in further detail with reference to the drawing in which.

DETAILED DESCRIPTION OF PREFERRED EMBODIMENTS

Figure 1:
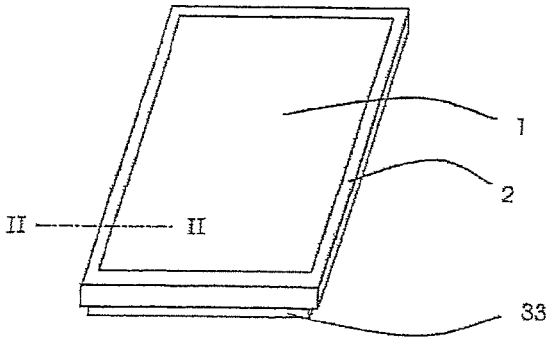
FIG. 1 is a perspective view of a bordered pane module according to the invention.

One embodiment of a bordered pane module made according to the invention is shown in FIG. 1. The pane module may be used for any type of window installed either vertically or inclined in the facade or the roof of any residential, office or industrial building. It comprises a pane element 1 (also referred to as pane in the following) and a border element 2 made preferably from polyurethane, said border element being produced by moulding on the pane element as will be explained later. One of the main functions of the border element is to create a structural joint between the pane element and a frame element (not shown) of a window.

In the embodiment shown, the border element 2 surrounds the entire border of the pane element, but it is to be understood that it may also be U-shaped surrounding the pane on three of its four sides or that separate elements may be used on each side leaving the corners of the pane free. Similarly it is to be understood that pane modules with other geometrical configurations are also conceivable, i.e. a pane module having a semicircular or triangular shape is also within the scope of the invention.

The border element 2 may be produced by using any suitable moulding technique, but injection moulding, e.g. reaction injection moulding (RIM), is preferred. When using the RIM process, which will described later, current-carrying components, plastic or metal components contributing to strength and stiffness, screws etc. may be moulded into the border element. Furthermore, the RIM process allows the integration of details such as sealings in the border element.

The pane element is usually composed of monolithic glass elements. In this context the term "monolithic glass" covers annealed glass, tempered glass, laminated glass, wired glass, figured or patterned glass as well as other types of glass that are used in conventional panes. Even if referred to as being made from glass, it is to be understood that Plexiglas (also known as Perspex) or any other sheet element, transparent or not, which is suited for the particular use of the window, may also be employed, including luminescent materials. The glass may be provided with coatings on one or both sides. The cavity between the sheet elements may be filled with dry air, gas such as Ar, Kr or Xe, or with gas mixtures suitable for improving the insulating properties of the pane by reducing its U value. A vacuum pane may also be used as may a pane with a layer of aerogel filling the space between the sheet elements. If using a pane type that can best be made in relatively small units, such as vacuum panes, a series of pane elements may be arranged side-by-side for the formation of a larger element of the desired size. This method may also be used for providing different areas of the pane with different properties such as colour, opacity, insulation etc.

The distance profiles or spacer members may be made from metal or plastic. A desiccant may be deposited in hollow distance profiles, embedded in a matrix or in a getter element in each of the cavities delimited by the glass sheets and the distance profiles. This may be done as a part of the pane module manufacture or the different elements may be pre-manufactured.

The sheet elements of the pane are normally plane and parallel to each other. They may, however, also be curved for use with a skylight of the curb type and the distance between them may vary, which may improve the sound insulating properties of the pane.

The pane element may be a conventional type pane, where all sheet elements have identical size and shape, or may be a step unit. Step units are panes, where the different glass sheets have different height and/or width so that one sheet projects over another at least at one edge thereof. Also panes comprising three or more sheet elements, such as for example three-sheet thermo panes, may be used as may combinations of different pane types such as a traditional thermo pane in combination with a single sheet pane.

Thanks to the continuous connection between the pane and the border element achieved by the moulding process, the pane module may function as a structural element contributing to bearing the loads affecting the window. This entails a different load distribution on the borders of the pane in comparison with a conventional pane, which again necessitates the use of glass, preferably tempered or annealed, that is thicker than that used when mounting the pane in a conventional manner, where there is no structural connection between the pane and the frame.

The encasement of the pane may be achieved in numerous ways. Some of these will be described in the following, which serves only as examples and is not supposed to be regarded as limiting to the scope of the invention.

Figure 2A:
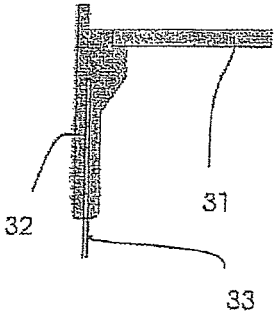
FIGS. 2*a* and 2*b* are cross sectional views taken along the line II-II in FIG. 1 and illustrating the manufacture and encasement of a step unit pane.
Figure 2B:
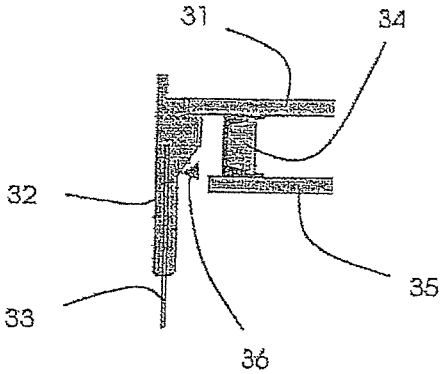

One way of making the bordered pane module is shown in FIG. 2. Firstly, a monolithic sheet of glass 31, which is preferably tempered or annealed, is provided with appropriate masking and/or priming (not shown) of the areas of attachment. The glass element 31 is then encased in a border element 32 by moulding as shown in FIG. 2A. The border element is preferably of polyurethane and a reinforcing element 33 may be embedded therein during the moulding process. The encased glass sheet is then combined with one or more additional monolithic sheets of glass 35 as shown in FIG. 2B. The glass sheets are kept apart by means of distance profiles 34 along the border of the glass sheets. In the embodiment shown, the pane produced is of the step unit type, but the method may also be employed for making panes with glass sheets of identical size and shape.

When making a step unit pane in this manner, a space 36 remains between the border element and edge of the non-encased glass sheet, allowing the introduction of a caulking device for the purpose of establishing a secondary pane sealing. The space is subsequently closed by means of a caulking compound such as a silicone-based joint filler.

Figure 2C:
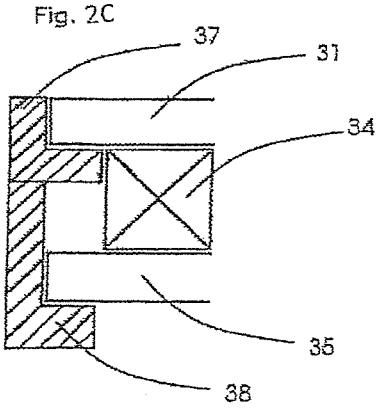
FIG. 2*c* is a cross sectional view of an alternative embodiment to the step unit pane of FIGS. 2*a* and 2*b*.

A variation of the method described in relation to FIGS. 2A and 2B is shown in FIG. 2C. Here, the spacer member 34 is recessed in relation to the edges of the two sheet elements 31, 35, which are substantially in line. As described above, the exterior sheet element 31 is encased in the border element prior to the assembly of the pane. The spacer member is preferably attached to the exterior sheet element prior to this moulding process as it may then serve as a limit for the moulding material and a particularly tight joint may be achieved. Upon assembly of the pane, the border element may be extended by the moulding of a second part 38 encasing the interior sheet element 35 and adhering to the first part 37. This method may of course also be used with panes, where the edges of the two sheet elements are not in line. In special circumstances the border element may also be constructed in three or more moulding steps. Multiple moulding steps may for example be advantageous if desiring a border element with different properties on the interior and exterior sides, e.g. different colour or different weather resistance.

The cavity formed between the glass sheets 31 and 35 and the distance profile 34 may be filled with an insulating gas. The advantages of the use of such a gas filling applies to all window panes described herein even if not stated explicitly.

The reinforcing element 33 is designed to also serve as a fitting for attaching the border element 32 to the frame of the window (not shown).

Another way of achieving the bordered pane module shown in FIG. 2B is to start with a finished pane element and then encasing the exterior glass sheet 31 thereof. The space 36 between the border element and the interior glass sheet can then be formed by means of a core in the mould.

Figure 3:
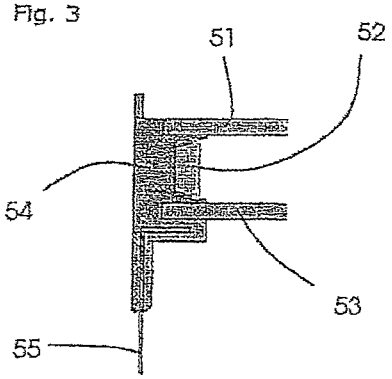
FIG. 3 is a cross sectional view corresponding to the ones in FIGS. 2*a* and 2*b* of a thermo pane, where the entire edge is encased in the border element, the border element being attached to the sealing.

A bordered pane module with a conventional pane having two glass sheets 51, 53 of identical size and shape may be made by encasing the pane as shown in FIG. 3. The encasing border element 54 adheres to the exterior glass sheet 51, to the sealing on the outside of the distance profile 52 and to the interior glass sheet 53. As the border element itself serves as a secondary sealing there is no need for a space as mentioned above. This, however, entails that the mould must be designed to compensate for variations in the thickness of the pane, which is not necessary when encasing only the exterior glass sheet.

Here, the pane is illustrated with a classical distance profile 52 used in common thermo panes, but the distance profile may also have means for attachment to the border element such as a projecting fitting (not shown), which is embedded in the border element during the moulding thereof. It may also be advantageous to provide the distance profile with surface characteristics, which allows the material of the border element to adhere directly thereto.

Furthermore, the distance profile may be provided with additional functionalities, such as sound dampening features, or additional members providing such functionalities may be provided in between the sheet elements of the pane.

Figure 9:
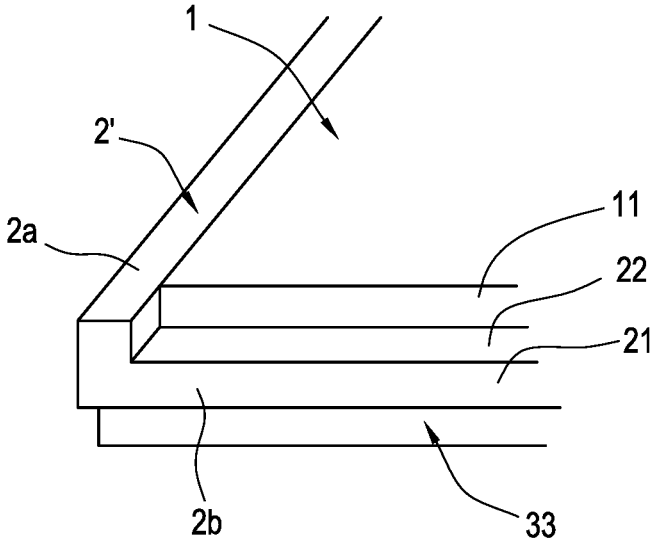
FIG. 9 is a fragmentary perspective view of another alternative form of pane module.
Figure 10:
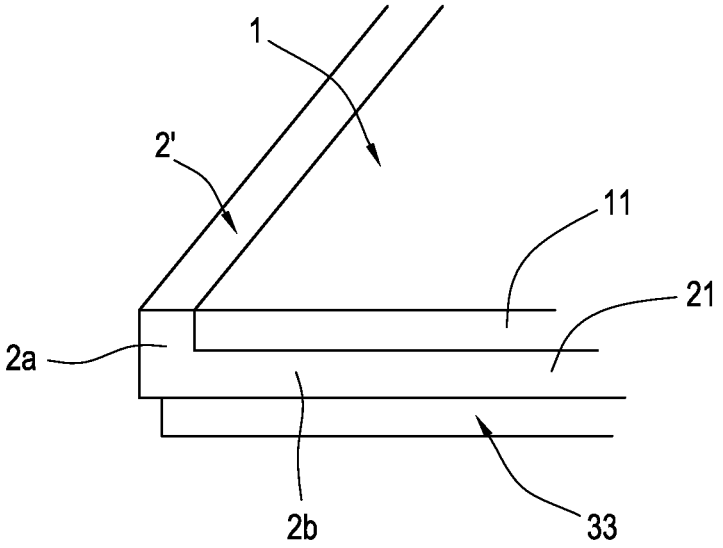
FIG. 10 is a fragmentary perspective view of a further alternative form of pane module.

As previously explained, border element 2 need not surround the entire periphery of pane element 1. FIGS. 9 and 10 illustrate two different examples in which the border element does not surround the entire periphery of pane element 1. It should be noted that pane element 1 may be a single sheet of glass or other material described herein. Further, pane element 1 could take the form depicted and/or described in connection with any of the other embodiments of the present invention. Where pane element 1 includes a second sheet, the border element 2' could be spaced from the second sheet as shown in, for example, FIG. 2*b*. The border element 2' could also encase the second sheet as depicted in, for example, FIG. 2*c*, FIG. 3, FIG. 4*a*, FIG. 4*b*, FIG. 5, FIG. 6 or FIG. 7. Referring to FIG. 9, border element 2' surrounds in a continuous manner only three of the four peripheral edge surfaces of the upper sheet element of pane element 1. As used herein, the terminology that the border element surrounds a peripheral surface portion means the border element extends along the entirety of the peripheral surface portion. The terminology that the border element surrounds a side surface means the border element extends along the entirety of the side surface. Further, the terminology that the border element surrounds a peripheral edge means the border element extends along the entirety of the peripheral edge. The three peripheral edge surfaces of the upper sheet element surrounded and contacted by lip 2*a* of border element 2' are the top peripheral edge surface, the left peripheral edge surface and the right peripheral edge surface. Bottom peripheral edge surface 11 of the upper sheet of pane element 1 remains exposed as no portion of the border element 2' contacts or surrounds bottom peripheral edge surface 11. Bottom peripheral edge surface 11 of the upper sheet of pane element 1 is offset inwardly from the bottom peripheral edge surface 21 of border element 2' exposing horizontal surface 22 of lip 2*b* of border element 2'. Preferably, lip 2*b* contacts the interior surface of the upper sheet of pane element 1 continuously along the entire periphery of the upper sheet. Further, in this embodiment, the upper surface of lip 2*a* forms the uppermost portion of border element 2' and is preferably flush with the exterior surface of the upper sheet of pane element 1. In this embodiment, no portion of border element 2' contacts the exterior surface of the upper sheet of pane element 1.

By offsetting surface 11 inwardly from surface 21, the surface 11 of the upper sheet of pane element 1 is protected during transport and/or handling. By configuring border element 2' such that surface 11 of the upper element is exposed, moisture cannot build or well-up in any imperfections in the connection between border element 2' and surface 11 as no portion of border element 2' contacts, surrounds or otherwise conceals surface 11. More specifically, no vertical joint is formed between surface 11 and border element 2'. Rather, water is free to run off the exterior surface of the upper sheet of pane element 1 and over surfaces 22 and 21 onto the surrounding structure of the building. It should be noted that the offset of surface 11 from surface 21 could be of a sufficient distance as to create a depression at the bottom of the pane module of sufficient size to house one or more add-ons. For example, the add-on housed in the depression could be a rain sensor or any other type of device used with a pane module of a window.

FIG. 10 is similar to the embodiment depicted in FIG. 9. The only difference being that surface 11 of the upper sheet of pane element 1 is vertically aligned with surface 21 of border element 2'. In this embodiment, like the embodiment depicted in FIG. 9, moisture cannot collect in any imperfections in the connection between surface 11 and border element 2' as surface 11 remains exposed, i.e., no portion of border element 2' contacts, abuts, surrounds or otherwise conceals surface 11.

Border elements 2' depicted in FIGS. 9 and 10 can be attached to pane element 1 by any moulding process described herein. Further, border elements 2' depicted in FIGS. 9 and 10 can be connected to a frame in any manner described herein.

Attachment of the moulding material, preferably polyurethane (PUR), of the border element to the glass sheet element is achieved purely by its adhesive properties. The adhesion is established during the moulding process. To achieve good adhesion the areas of attachment may be primed and/or covered by a mask.

Priming is performed on masked and non-masked adhesion areas of the glass and possibly also on a spacer bar between the glass sheets. A suitable primer is Carlofon Schwarzprimer EFTEC DV 990, which may also function as a masking. The primer is usually a liquid, which can be applied to the surfaces by means of a brush or a felt pad.

The masking further increases the adherence of the moulding materials thereby contributing to an optimal encasement. The adhesion strength at the adhesion surface should preferably be larger than the cohesive strength of the moulding material and it will come to a cohesive failure if the pane element is torn from the border element. The masking may be a UV hardening lacquer, a one- or two-component lacquer or any other suitable material, but a ceramic coating is preferred.

The masking has the further purpose of contributing to the aesthetic value of the window and to protect adherents and the pane sealing from sunlight. The mask is generally lightproof but must as a minimum be non-transparent for UV-A and UV-B light.

The border element can be made from a thermo plastic or a thermoset material. For either type of material the pane module and inserts are placed in a mould and the material is injected when the mould has been closed. Thermoplastic material such as PVC, PE or PP, a thermoplastic elastomeric, TPE, or a single component thermoset elastomer materials such as EPDM, however, requires high pressure and relatively high process temperature, typically about 200° C., which means that the temperature of the pane element can reach 140° C. Such high temperatures may be disadvantageous when using large size pane modules or when the border element is to be in contact with the secondary sealing of the pane module or has an additional function as a secondary sealing, in which case another method should be used.

Moreover, plasticizers for instance in PVC may cause damage to painted parts or to the sealing of the pane module and such materials should therefore be kept apart.

The apolar nature of many thermo plastic materials causes poor affinity to other materials. To obtain adhesion to glass a priming of the surface is therefore vital. A suitable primer may consist of an isotactic chlorinated polypropylene grafted with maleic anhydride and an epoxysilane.

To overcome the disadvantages described above, the border element can be made by reaction injection moulding (RIM), which is a process that is well known per se. A two-component curing moulding material is mixed in a mixerhead and injected into a closed mould containing the pane to be encased.

Polyurethane (PUR) is particularly preferred as moulding material as it has good thermal insulating properties, is resistant to heat and dimensionally stable and performs well under the influence dynamical loads. In addition it is resistant to UV radiation, acids, solvents and a wide spectrum of potentially harmful chemicals. This entails an excellent weather resistance and thus a slow ageing.

The polyurethane is usually composed from a polyol and an isocyanate, which polymerizes by an exothermic reaction. The use of a monomer means that the finished product is free from the tensions that would have occurred if using a thermoplastic material. The polyurethane components have a very low viscosity of approximately 50-150 Pa s.

Most favourable for making the border element on a pane element is the RIM process. In the RIM process a thermoset polyurethane border element is made by mixing a polyol and an isocyanate in a mould. The polymerisation is an exothermic chemical process and thus the pressure and temperature in the mould is low compared to the processes using thermoplastic material. This considerable reduces the risk of glass breakage or damaging the sealing of the pane element during the moulding process. In the RIM process the mould is filled with in seconds and it is ready for demoulding in 30-60 seconds. Priming of the adhesion surfaces of the material of the pane element is necessary to obtain adhesion. A suitable primer is Carlofon Schwarprimer (Eftec DV 990).

During the RIM-process both pressure and temperature can be kept relatively low. In the mould a pressure of approximately 3 to 10 bar is obtained during the curing process and the temperature of the material and the mould is between 70 and 110° C. depending on the configuration of the mould and whether the polyurethane used is of the aromatic or the aliphatic kind. This allows for relatively large variations in the material thickness and components made from steel, aluminium, glass as well as electrical sensors, wiring etc. may be embedded. Additionally the costs associated with the manufacture of the moulds are low and the surface characteristics, such as roughness, determined by the surfaces of the mould are excellent.

The cured module is ready to be handled within approximately 45 to 60 seconds at which time a typical PUR will have gained approximately 60-70% of its final strength. According to the kind of polyurethane used different Shore A hardnesses may be obtained, for example a cured hardness of 60-90 Shore A and the density of the cured material will be 100-800 kgjm$^3$.

The mechanical strength of the cured elements may be increased by admixing fibres such as glass fibres in one of the two components of the moulding material. This process is called Reinforced Reaction Injection Moulding (R-RIM). Furthermore, fibre mats, webs and the like may be laid in the mould prior to the injection of the moulding material. This process is called Structural Reaction Injection Moulding (S-RIM). Laying the sheet elements of the pane in the mould and encasing it with the moulding material during the formation of the border element may be seen as a variant of the S-RIM process. The R-RIM and S-RIM processes may of course be combined.

Figure 8:
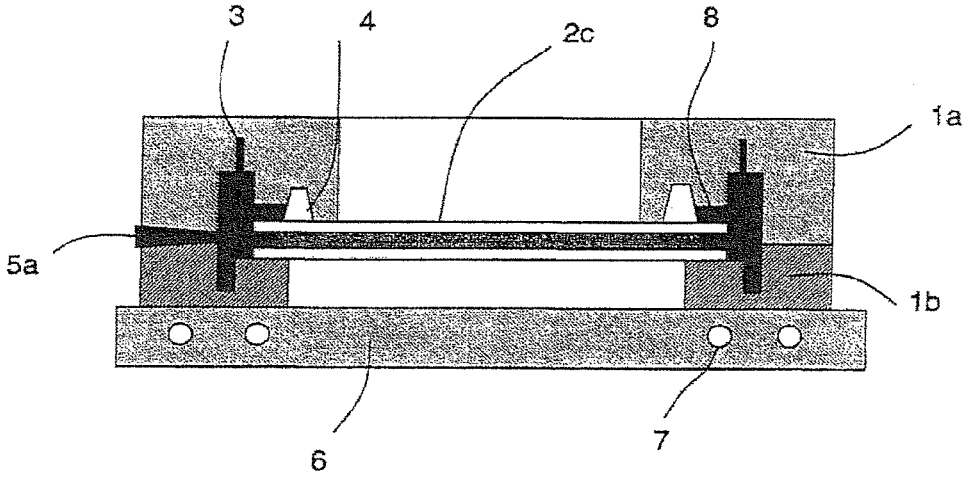
FIG. 8 shows a cross sectional view of a mould for making a bordered pane module corresponding to the one in FIG. 3.

A mould 801 for use in the manufacture of a window according to the invention is shown in FIG. 8. As may be seen the mould is composed of two parts 801*a* and 801*b*, where the lower mould part 801*b* is arranged on a mould bench 806 with heating ducts 807 for adjusting the mould temperature. The upper mould part can be opened or removed to allow insertion of a window pane 802*c* and removal of the bordered pane module when finished. The pane rests on the lower mould part during the moulding process. In this embodiment a thermo pane is used and the moulding material (black colour) not only adheres to the two sheet elements of the pane but also to the pane sealing. Other types of panes may, however, also be used and the shape of the border element may be different possibly leading to different faces of attachment. Fittings 803 to be embedded in the border element during moulding thereof fixated in the upper mould part 801*a* when opened and are retained thereby during the moulding process. Other components such as wiring etc. may also be encased or embedded in the moulding material provided that they can resist the conditions present during the moulding process. In the same way gaskets 804 may be held by the upper mould part. These gaskets serve to proof the joint between the mould cavity and the surroundings and are not a part of the pane module. If given an appropriate geometry, the gaskets may create an under cut at the outer edge of the moulded object. This is of course only possible when using a flexible gasket as it would otherwise be impossible to remove the upper mould part after curing of the moulding material.

The moulding material is mixed in a mixer head (not shown) and is then introduced into the mould via the inlet 805*a*. Any material left in the inlet is removed by cutting or milling when the cured module has been removed from the mould.

In short the course of the moulding process may be as follows:

a) A pane element is primed on the adhesion surfaces with an appropriate primer.
b) The primed surfaces are allowed to dry.
c) A release agent is applied to the mould.
d) The pane element is inserted in the open mould and positioned.

e) Fittings and other component to be embedded or encased in the border element are inserted in the mould and fixated.
f) The mould is closed.
g) The moulding material, preferably PUR, is injected.
h) The moulding material is polymerised.
i) The mould is opened and the pane module is removed.
j) The bordered pane module is cleaned, i.e. release agent is removed from the pane and the border element and surplus moulding material at the inlet, venting ducts etc. as well as possible flashes are cut off and polished with fine steel wool.

Figure 4A:
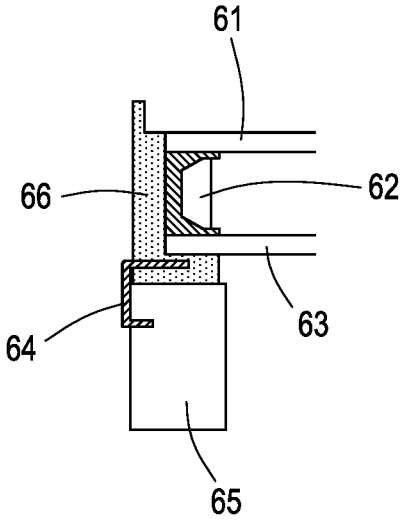
FIGS. 4*a* and 4*b* are cross sectional views corresponding to the one in FIG. 3 and showing the integration of the frame in the border element.
Figure 4B:
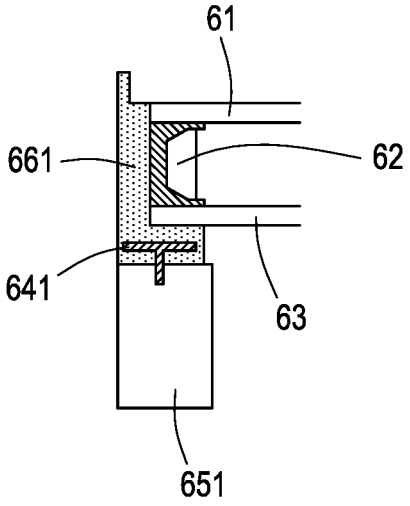

As mentioned above, the frame may also be made by moulding. This may be done in exactly the same way as when moulding the border member. The connection between the frame and the border element may be based solely on the adhesion of the moulding materials used for the two elements, which may be promoted by an appropriate priming of the areas of attachment. If desiring an even stronger connection a reinforcing element may, however, also be embedded with one end in the border element and the other in the frame as shown in FIGS. 4A and 4B. Under normal circumstances it makes no difference whether the frame or border element is moulded first or if they are made simultaneously. A certain sequence may, however, be necessary if they are made from different materials and one does not tolerate the moulding conditions necessary for the making of the other or to promote the adhesion between the two materials.

A moulded connection between the frame and the border element provides a particularly secure connection. It, however, necessitates the use of a mould that is big enough to hold both the frame and the pane element. Furthermore, it prevents subsequent detachment of the bordered pane module, meaning that the entire frame must be replaced if the pane is broken. This is of course a source of additional cost, but may in return be done by persons that are not specially trained for the purpose.

FIGS. 3 and 4 show conventional type thermo panes, but the methods described in relation thereto may also be applied to the encasement of step unit panes as long as the edge of the larger glass sheet does not project too far over that of the smaller glass sheet. Likewise, the method shown in FIG. 2 may be combined with those of FIGS. 3 and 4 in that for example the upper and lower edges of the pane are encased by one method and the side edges by another. This is particularly advantageous when using a step unit, in which the larger glass sheet only projects over the smaller one at some sides, whereas their edges are in line at the others.

Similarly, a combination of different types of panes may be used such as the combination of a thermo or vacuum pane with a single sheet pane. In this case a distance member keeping the distance between the different panes may be made as an integral part of the border element; preferably by moulding it with a projection projecting into the space between the panes.

Furthermore, it is to be understood, that one or more pane sheets could be replaced with sheets of other materials having e.g. decorative or insulating qualities.

The frame element can be made from wood, plastic, polyurethane, polyurethane with a wooden core or any other material suited for the manufacture of window frames. If using a non-mouldable material, the connection to the border element may be achieved by means of any detachable or undetachable connecting means. Examples of detachable connecting means are screws, nails or other mechanical connection means, e.g. a click-system. Examples of undetachable connecting means are glue or adhesives. Examples of detachable systems are shown in FIGS. 5 and 6.

Figure 5:
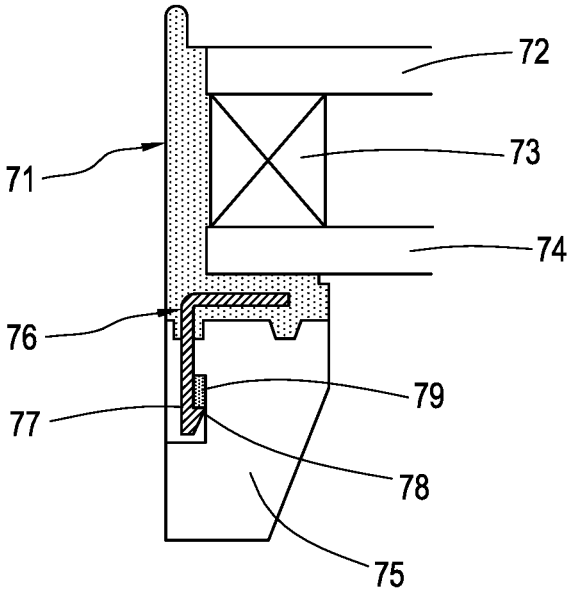
FIG. 5 is a cross sectional view corresponding to the one in FIG. 3 and showing the attachment of the border element to the frame by means of a click-on system.

In FIG. 5 the border element 71 encases the exterior glass sheet 72, the distance profile and pane sealing 73, as well as the interior glass sheet 74. A fitting 76 embedded in the border element 71 has a tongue 77 with a barb 78, which engages with a catcher 79 on the frame element 75.

Figure 6:
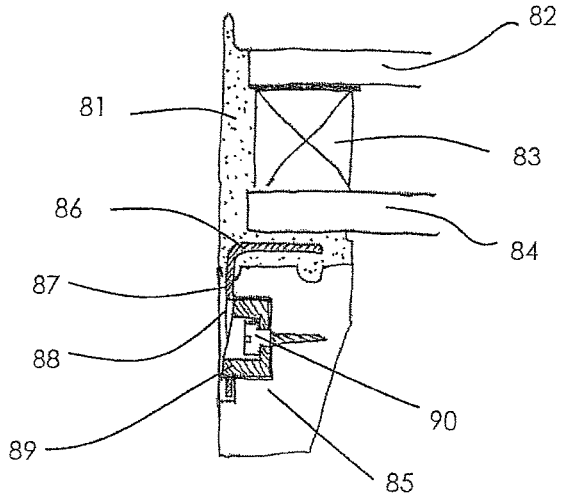
FIG. 6 is a cross sectional view corresponding to the one in FIG. 3 and showing the attachment of the border element to the frame by means of a fitting attached to the frame with screws.

The system depicted in FIG. 6 corresponds to the one in FIG. 5 as regards the overall configuration of the pane, border element, fitting and frame. In this case, however, the frame is provided with a fixation bushing 89 arranged to engage with a hole 88 in the projecting part 87 of the fitting 86. By turning the fixation bushing over 180 degrees, the tongue is engaged or disengaged. A screw 90 is used for fastening the bushing 89 in the frame element upon engagement of the tongue.

The connection between the border element and the frame element is made in a manner that creates a watertight connection or at least so that moisture and water may be drained off in a controlled manner.

Releasable connections of the types described above have the advantage of allowing the pane module to be replaced. This not only allows the replacement of broken panes, but has much wider implications: An existing building may for example be given a new look by replacing the pane modules with ones of different appearance or the insulating properties of a building may be improved by replacing pane modules comprising older type panes with new ones having better properties.

Moreover, the frames and pane modules can be manufactured and stored separately and then be interconnected once the requirements for a given window has been established. In this way windows may effectively be custom made from a pick-and-click system of different components.

In special circumstances the border element may be connected directly to the load-bearing structure.

By forming the border element by encasement of the pane in the manner described in the above, a number of functional faces are obtained. That is, in contradistinction to a traditional pane it is possible to integrate a plurality of functions into the border element. An example of an embodiment of the border element with different functional faces is shown in FIG. 7.

Figure 7:
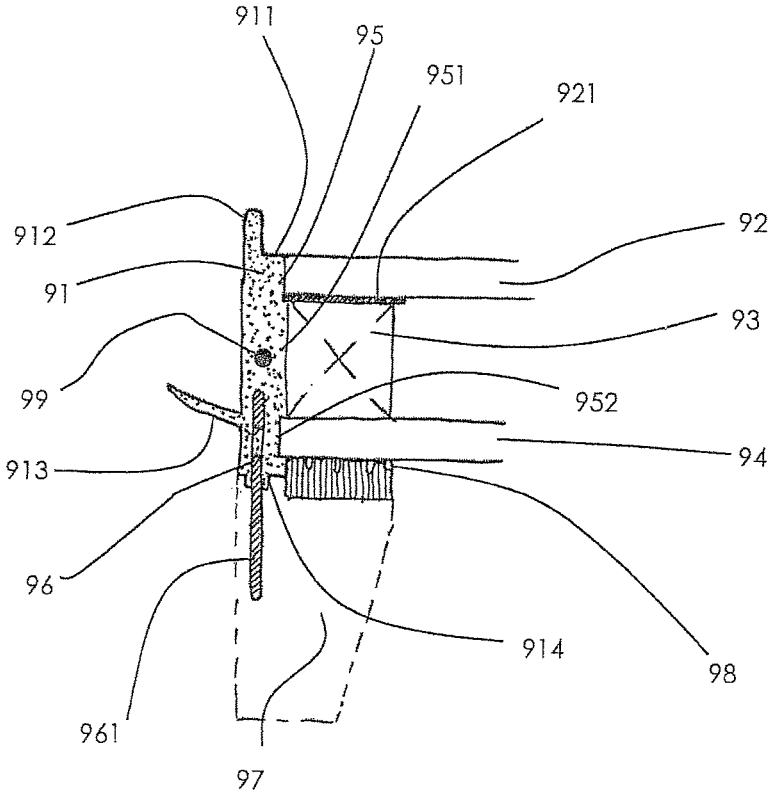
FIG. 7 is a cross sectional views corresponding to the one in FIG. 3 and showing border elements with straight and angled fittings, respectively.

In FIG. 7 the top face, i.e. the upper or exterior functional face of the border element 91, is provided with a projecting feather 912, which will prevent water from running from the exterior surface of the pane into the space between the sash and frame or between the frame and the bearing structure (not shown) depending on the window type.

On the face facing away from the pane (left side in FIG. 7), a tongue-like weather strip 913 is provided for tightening the space between the two frames (not shown) of the window.

A fitting 96 projects out trough the bottom functional face 914 facing downwards in FIG. 7. The projecting part 961 of the fitting 96 is used for fixating the border element 91 and thus also the pane to the frame element. In addition thereto the surface of the border element itself is provided with a bead, which fits with groove in the frame element 97 and thus serves as a guide for the positioning of the border and frame elements in relation to each other.

A gasket 98 is provided between the interior glass sheet 94 and the frame element 97 for relieving the border of the pane and for draining off condensation forming on the inside of the pane and preventing it from reaching the border element 91 and pane sealing 93.

As described above, fittings may advantageously be used for the interconnection of the different parts of the window, but they may also serve other purposes. They may for example be used as strengthening and/or stiffening means, hinges, locking assemblies, reception means for receiving screws and other fastening means, current carriers, holders for claddings and/or coverings etc.

Further functionalities may be provided inside the border element. An example of this is the provision of a current-carrying component 99 providing an electrical connection between a solar energy collector (not shown) in the pane element and an electrical window openers, a roller shutter, a light source, a display showing meteorological information, sensors controlling ventilation or the like. Other examples are the provision of optical fibres or a passage for a curtain cord.

An embedded member may also be used for providing a pre-stressing of the border element, which may counteract harmful stresses on the pane caused by wind suction. Such influences are particularly pronounced with roof windows mounted in inclined roof surfaces and in the case of centre-hung windows primarily affect the lowermost half of the pane, which is being dragged outwards and upwards. This causes compressive stresses on the pane, which may eventually cause it to break. By embedding a tensioned cable 99 in the material of the border element during moulding, a compressive force corresponding to the force of the tensioning will be applied to the material of the border element. Only wind forces, which are greater than the force of the tensioning, will thus cause stresses on the pane. The pre-stressing of the border element can of course be applied to the entire border element, but can also be limited to those border members, where it is most needed. As will be apparent to those skilled in the art, the pre-stressing may also be achieved in other ways, e.g. by tensioning the fittings 33,55,64,641,76,86,96 or by applying a pre-stressed member (not shown) at level with or above the outer surface of the pane. A similarly effect could also be achieved by locally increasing the stiffness of the material of the border element, thus not actually causing a pre-stressing but instead increasing its resistance to bending.

These functional units and many others may be achieved as a part of the moulding process either by moulding the border element with the necessary projections etc. or by embedding or encasing additional elements.

With the mould depicted in FIG. 8 the border element will get a shape corresponding to the one shown in FIG. 3. If one or more sides of the border element are to have different shapes, e.g. to achieve some of the functional faces mentioned in relation to the other figures, the mould should be designed accordingly. Particularly if using a moulded frame the mould used should be of considerably larger dimensions.

In the above, the pane module has been described as either constituting a sash in itself or as constituting an element to be coupled to a further element to constitute a sash, in the sense that the sash is openable. The sash could also be fixed, i.e. not openable in the traditional sense but connected to a traditional frame. Furthermore, it would be possible to integrate the sash and the frame into a single element, or to form the sash as a traditional window frame for connection to the roof structure. All of these interpretations could be applied to the term "frame" within the context of the present application.

Furthermore, it is conceivable to make use of other configurations of the pane element. For instance, there may be more than two sheets of glass, and the sheets need not to be plane and/or parallel with each other. A further alternative conception lies in the possibility of applying at least some of the principles underlying the present invention to pane modules including a single sheet of glass.

In general, the features of the embodiments shown and described may be combined freely and no feature should be seen as essential unless stated in the claims.

We claim:

1. A pane module configured to be installed in a window for a building structure, said pane module comprising:

a pane including a first sheet, said first sheet being glass or other glazing material, said first sheet having an exterior surface and an interior surface, said first sheet further including four peripheral surface portions defining a periphery of said first sheet, said four peripheral surface portions being a top peripheral surface portion, a bottom peripheral surface portion, a left peripheral surface portion and a right peripheral surface portion, wherein each of said top peripheral surface portion, said bottom peripheral surface portion, said left peripheral surface portion and said right peripheral surface portion extend between said exterior surface and said interior surface of said first sheet;

a moulded border element being configured to contact and surround three of said four peripheral surface portions while leaving one of said four peripheral surfaces portions of said first sheet exposed; and, connecting means for connecting said border element to said first sheet, said connecting means being a process of moulding in which said border element is formed and undetachably adhered to said first sheet.

2. The pane module of claim 1, wherein:

said first sheet has one of: (i) a circular configuration; (ii) a triangular configuration; and (iii) a rectangular configuration.

3. The pane module of claim 1, wherein:

said pane includes a second sheet connected to said first sheet, said second sheet is glass or other glazing material.

4. The pane module of claim 3, wherein:

said second sheet is disposed relative to said moulded border element so that no portion of said second sheet contacts said moulded border element.

5. The pane module of claim 3, wherein:

said second sheet is disposed relative to said moulded border element such that at least a portion of said second sheet contacts said moulded border element.

6. The pane module of claim 1, wherein:

said moulded border element contacts and surrounds said top peripheral surface portion, said left peripheral surface portion and said right peripheral surface portion of said first sheet while leaving said bottom peripheral surface portion of said first sheet exposed.

7. The pane module of claim 6, wherein:

said bottom peripheral surface portion of said first sheet is offset inwardly from a bottom peripheral surface of said moulded border element.

8. The pane module of claim 6, wherein:

said bottom peripheral surface portion of said first sheet is vertically aligned with a bottom peripheral surface of said moulded border element.

9. A pane module configured to be installed in a window for a building structure, said pane module comprising:

a pane including a first sheet, said first sheet being glass or other glazing material, said first sheet having an exterior surface, an interior surface and n number of side surfaces, wherein n is a number greater than one, each of said n-number of side surfaces extending between said exterior surface and said interior surface of said first sheet;

a moulded border element being configured to contact and surround n−1 number of side surfaces of said first sheet while leaving one of said n number of side surfaces of said first sheet exposed; and, connecting means for connecting said border element to said first sheet, said connecting means being a process of moulding in which said border element is formed and undetachably adhered to said first sheet.

10. The pane module of claim 9, wherein:

said first sheet has one of: (i) a circular configuration; (ii) a triangular configuration; and (iii) a rectangular configuration.

11. The pane module of claim 9, wherein:

said pane includes a second sheet connected to said first sheet, said second sheet is glass or other glazing material.

12. A pane module as recited in claim 11, wherein:

no portion of said moulded border element contacts said exterior surface of said first sheet.

13. A pane module as recited in claim 12, wherein:

said moulded border element contacts said interior surface of said first sheet along an entire periphery of said interior surface of said first sheet.

14. A pane module as recited in claim 12, wherein:

said moulded border element includes a first lip, said first lip contacts said interior surface of said first sheet on each of a top of said interior surface, a bottom of said interior surface, a left side of said interior surface and a right side of said interior surface, said moulded border element further includes a second lip extending upwardly and at an angle to said first lip, said second lip having only three sides, each of said three sides of said second lip contact a corresponding side surface of said first sheet.

15. A pane module configured to be installed in a window for a building structure, said pane module comprising:

a pane including a first sheet and a second sheet connected to said first sheet, said first sheet and said second sheet being glass or other glazing material, said first sheet having an exterior surface and an interior surface, said first sheet further including four peripheral surface portions defining a periphery of said first sheet, said four peripheral surface portions being a top peripheral surface portion, a bottom peripheral surface portion, a left peripheral surface portion and a right peripheral surface portion, wherein each of said top peripheral surface portion, said bottom peripheral surface portion, said left peripheral surface portion and said right peripheral surface portion extend between said exterior surface and said interior surface of said first sheet;

a moulded border element and connecting means for connecting said border element to said first sheet, said connecting means being a process of moulding in which said border element is formed and undetachably adhered to said first sheet; and, said moulded border element including a first portion and a second portion, said first portion contacting an interior surface of said first sheet, said first portion further extending along the entirety of said periphery of said first sheet, said second portion contacts and surrounds said top peripheral surface portion, said left peripheral surface portion and said right peripheral surface portion of said first sheet while leaving said bottom peripheral surface portion of said first sheet exposed.

16. The pane module as recited in claim 15, wherein:

said moulded border element further includes an interior surface, an exterior surface and a bottom peripheral surface which extends between said interior surface of said moulded border element and said exterior surface of said moulded border element, said bottom peripheral surface of said moulded border element is aligned with said bottom peripheral surface portion of said first sheet in a direction perpendicular to the exterior surface of said first sheet.

17. The pane module as recited in claim 15, wherein:

said moulded border element further includes an interior surface, an exterior surface and a bottom peripheral surface which extends between said interior surface of said moulded border element and said exterior surface of said moulded border element, said bottom peripheral surface portion of said first sheet is offset inwardly from said bottom peripheral surface of said moulded border element.

18. The pane module of claim 17, wherein:

said bottom peripheral surface portion of said first sheet is offset inwardly from said bottom peripheral surface of said moulded border element a sufficient distance to form a depression in said pane module of a sufficient size to house at least one add-on element.

19. The pane module of claim 18, wherein:

said at least one add-on element is a rain sensor.

20. The pane module of claim 15, wherein:

no portion of said moulded border element contacts said exterior surface of said first sheet and an uppermost surface of said moulded border element is flush with said exterior surface of said first sheet.

* * * * *